US010415384B2

(12) United States Patent
Lugg et al.

(10) Patent No.: US 10,415,384 B2
(45) Date of Patent: Sep. 17, 2019

(54) MINING MACHINE WITH MULTIPLE CUTTER HEADS

(71) Applicant: Joy MM Delaware, Inc., Wilmington, DE (US)

(72) Inventors: Peter A. Lugg, Queensland (AU); Geoffrey W. Keech, Queensland (AU); Bradley M. Neilson, New South Wales (AU); Nagy Daher, Monterey (AU); Ric Boyd, Balgownie (AU)

(73) Assignee: Joy Global Underground Mining LLC, Warrendale, PA (US)

( * ) Notice: Subject to any disclaimer, the term of this patent is extended or adjusted under 35 U.S.C. 154(b) by 0 days.

(21) Appl. No.: 15/418,490

(22) Filed: Jan. 27, 2017

(65) Prior Publication Data

US 2017/0211383 A1 Jul. 27, 2017

Related U.S. Application Data

(60) Provisional application No. 62/287,682, filed on Jan. 27, 2016, provisional application No. 62/377,150, (Continued)

(51) Int. Cl.
*E21C 27/10* (2006.01)
*E21C 25/18* (2006.01)
(Continued)

(52) U.S. Cl.
CPC ..... *E21C 25/18* (2013.01); *E21C 27/02* (2013.01); *E21C 29/22* (2013.01); *E21C 31/08* (2013.01); *E21C 35/20* (2013.01)

(58) Field of Classification Search
CPC ..... E21C 27/20; E21C 27/12; E21D 9/102; E21D 9/1026
See application file for complete search history.

(56) References Cited

U.S. PATENT DOCUMENTS 2,517,267 A 8/1950 Watson
2,619,338 A 11/1952 Lindgren
(Continued)

FOREIGN PATENT DOCUMENTS

AU 466244 2/1972
CA 2141984 8/1996
(Continued)

OTHER PUBLICATIONS

International Search Report and Written Opinion for Application No. PCT/US2017/015487 dated Apr. 10, 2017 (17 pages).

*Primary Examiner* — Janine M Kreck
(74) *Attorney, Agent, or Firm* — Michael Best & Friedrich LLP

(57) ABSTRACT

A mining machine includes a frame, a boom supported for pivoting movement relative to the frame, and a cutter head pivotably coupled to the boom. The cutter head includes a housing, a cutter shaft coupled to the housing, a cutting disc, and an excitation mechanism. A second portion of the cutter shaft extends parallel to a cutter axis. The cutting disc is coupled to the second portion of the cutter shaft and is supported for free rotation relative to the cutter shaft about the cutter axis. The cutting disc includes a plurality of cutting bits defining a cutting edge. The excitation mechanism includes an exciter shaft and a mass eccentrically coupled to the cutter shaft. The excitation mechanism is coupled to the first portion of the cutter shaft. Rotation of the exciter shaft induces oscillating movement of the second portion of the cutter shaft and the cutting disc.

9 Claims, 16 Drawing Sheets

Related U.S. Application Data filed on Aug. 19, 2016, provisional application No. 62/398,834, filed on Sep. 23, 2016, provisional application No. 62/398,744, filed on Sep. 23, 2016, provisional application No. 62/398,717, filed on Sep. 23, 2016.

(51) Int. Cl.

| | |
|---|---|
| ***E21C 29/22*** | (2006.01) |
| ***E21C 31/08*** | (2006.01) |
| ***E21C 27/02*** | (2006.01) |
| ***E21C 35/20*** | (2006.01) |

(56) References Cited

U.S. PATENT DOCUMENTS

| | | | | |
|---|---|---|---|---|
| 2,619,339 | A | 11/1952 | Cartlidge | |
| 2,654,586 | A | 10/1953 | Berry | |
| 2,659,585 | A | 11/1953 | McCallum | |
| 2,745,651 | A | 5/1956 | Herrmann | |
| 2,776,823 | A | 1/1957 | Barrett | |
| 3,197,256 | A | 7/1965 | Hlinsky | |
| 3,353,871 | A | 11/1967 | Arentzen | |
| 3,412,816 | A | 11/1968 | Lautsch | |
| 3,446,535 | A | 5/1969 | Lauber | |
| 3,647,263 | A | 3/1972 | Lauber et al. | |
| 3,663,054 | A * | 5/1972 | Dubois | E21D 9/117 299/18 |
| 3,719,404 | A | 3/1973 | Sterner | |
| 3,840,271 | A | 10/1974 | Sugden | |
| 3,922,017 | A | 11/1975 | Cobb | |
| 3,972,571 | A | 8/1976 | Benkowski | |
| 3,995,907 | A | 12/1976 | Dubois | |
| 4,005,905 | A | 2/1977 | Dubois | |
| 4,108,494 | A | 8/1978 | Kogler | |
| 4,230,372 | A | 10/1980 | Marten | |
| 4,248,481 | A * | 2/1981 | Stoltefuss | E21D 9/0875 299/33 |
| 4,273,383 | A | 6/1981 | Grisebach | |
| 4,377,311 | A | 3/1983 | Seller | |
| 4,470,635 | A | 9/1984 | Paurat et al. | |
| 4,516,807 | A | 5/1985 | Eagles | |
| 4,647,112 | A | 3/1987 | Demoulin et al. | |
| 4,662,684 | A | 5/1987 | Marten | |
| 4,682,819 | A | 7/1987 | Masse | |
| 4,755,002 | A | 7/1988 | Parrott | |
| 4,760,513 | A | 7/1988 | Edwards | |
| 4,796,713 | A | 1/1989 | Bechem | |
| 4,838,614 | A | 6/1989 | Pentith et al. | |
| 4,838,615 | A | 6/1989 | Oldham | |
| 5,028,092 | A | 7/1991 | Coski | |
| 5,087,102 | A | 2/1992 | Kiefer | |
| 5,190,353 | A | 3/1993 | Bechem | |
| 5,210,997 | A | 5/1993 | Mountcastle, Jr. | |
| 5,601,153 | A | 2/1997 | Ensminger et al. | |
| 5,676,125 | A | 10/1997 | Kelly et al. | |
| 5,697,733 | A | 12/1997 | Marsh | |
| 5,938,288 | A | 8/1999 | Saint-Pierre et al. | |
| 6,086,257 | A | 7/2000 | Lee | |
| 6,561,590 | B2 | 5/2003 | Sugden | |
| 6,857,706 | B2 | 2/2005 | Hames et al. | |
| 7,182,407 | B1 * | 2/2007 | Peach | E21C 25/16 299/75 |
| 7,325,882 | B2 | 2/2008 | Sugden et al. | |
| 7,384,104 | B2 | 6/2008 | Sugden | |
| 7,431,402 | B2 | 10/2008 | Peach et al. | |
| 7,490,911 | B2 | 2/2009 | Steinberg et al. | |
| 7,695,071 | B2 | 4/2010 | Jackson et al. | |
| 7,934,776 | B2 | 5/2011 | de Andrade et al. | |
| 8,079,647 | B2 | 12/2011 | Yao et al. | |
| 8,328,292 | B2 | 12/2012 | de Andrade et al. | |
| 8,727,450 | B2 | 5/2014 | de Andrade et al. | |
| 9,470,087 | B2 | 10/2016 | Smith et al. | |
| 2002/0093239 | A1 | 7/2002 | Sugden | |
| 2005/0200192 | A1 | 9/2005 | Sugden et al. | |
| 2007/0090678 | A1 | 4/2007 | Peach et al. | |
| 2007/0193810 | A1 | 8/2007 | Steinberg et al. | |
| 2008/0156531 | A1 | 7/2008 | Boone et al. | |
| 2009/0058172 | A1 | 3/2009 | DeAndrade et al. | |
| 2009/0066148 | A1 | 3/2009 | Willison | |
| 2009/0127918 | A1 | 5/2009 | Yao et al. | |
| 2010/0260563 | A1 | 10/2010 | Conroy et al. | |
| 2011/0062768 | A1 | 3/2011 | Van Zyl et al. | |
| 2011/0181097 | A1 | 7/2011 | Skea | |
| 2013/0057044 | A1 | 3/2013 | De Andrade et al. | |
| 2014/0077578 | A1 * | 3/2014 | Smith | E21C 25/06 299/1.4 |
| 2014/0091612 | A1 | 4/2014 | Rowher et al. | |
| 2015/0152728 | A1 | 6/2015 | Hartwig et al. | |

FOREIGN PATENT DOCUMENTS

| | | | |
|---|---|---|---|
| CL | 35975 | | 9/1987 |
| CN | 102305067 | A | 1/2012 |
| CN | 102587911 | | 7/2012 |
| CN | 102606154 | A | 7/2012 |
| CN | 10204927 | | 10/2012 |
| CN | 102733803 | | 10/2012 |
| DE | 4123307 | C1 | 12/1992 |
| DE | 4440261 | | 5/1996 |
| DE | 19900906 | A1 | 7/2000 |
| EP | 0329915 | A1 | 8/1989 |
| SU | 581263 | | 11/1977 |
| SU | 619117 | | 8/1978 |
| SU | 750061 | | 7/1980 |
| SU | 962626 | | 9/1982 |
| SU | 1328521 | | 8/1987 |
| SU | 1731946 | | 5/1992 |
| WO | 0043637 | | 7/2000 |
| WO | 0046486 | | 8/2000 |
| WO | 0201045 | | 1/2002 |
| WO | 02066793 | | 8/2002 |
| WO | 2003062587 | | 7/2003 |
| WO | 03098761 | | 10/2003 |

* cited by examiner

MINING MACHINE WITH MULTIPLE CUTTER HEADS

CROSS-REFERENCE TO RELATED APPLICATIONS

This application claims the benefit of prior-filed, U.S. Provisional Patent Application No. 62/287,682, filed Jan. 27, 2016, U.S. Provisional Patent Application No. 62/377,150, filed Aug. 19, 2016, U.S. Provisional Patent Application No. 62/398,834, filed Sep. 23, 2016, U.S. Provisional Patent Application No. 62/398,744, filed Sep. 23, 2016, and U.S. Provisional Patent Application No. 62/398,717, filed Sep. 23, 2016. The entire contents of each of these documents are hereby incorporated by reference.

BACKGROUND

The present disclosure relates to underground mining machines, and in particular to a mining machine including multiple cutter heads.

Hard rock excavation typically requires imparting large energy on a portion of a rock face in order to induce fracturing of the rock. One conventional hard rock mining technique includes operating a cutter head having multiple mining picks. Due to the hardness of the rock, this method is often impractical because the picks must be replaced frequently, resulting in extensive down time of the machine. Another technique includes drilling multiple holes into a rock face and inserting an explosive device into the holes. The explosive forces fracture the rock, and the rock remains are then removed and the rock face is prepared for another drilling operation. This technique is time-consuming and exposes operators to significant risk of injury due to the use of explosives and the weakening of the surrounding rock structure. Yet another technique utilizes roller cutting element(s) that rolls or rotates about an axis that is parallel to the rock face, but this technique requires imparting large forces onto the rock to cause fracturing.

SUMMARY

In one aspect, a mining machine includes a frame, a boom supported for pivoting movement relative to the frame, and a cutter head pivotably coupled to the boom. The cutter head includes a housing, a cutter shaft coupled to the housing, a cutting disc, and an excitation mechanism. The cutter shaft includes a first end, a second end, a first portion positioned adjacent the first end, and a second portion positioned adjacent the second end. The second portion extends parallel to a cutter axis. The cutting disc is coupled to the second portion of the cutter shaft and is supported for free rotation relative to the cutter shaft about the cutter axis. The cutting disc includes a plurality of cutting bits defining a cutting edge. The excitation mechanism includes an exciter shaft and a mass eccentrically coupled to the cutter shaft. The exciter shaft is driven for rotation relative to the cutter shaft about an exciter axis. The excitation mechanism is coupled to the first portion of the cutter shaft. Rotation of the exciter shaft induces oscillating movement of the second portion of the cutter shaft and the cutting disc.

In another aspect, a mining machine includes a frame, a first boom supported for pivoting movement relative to the frame, a second boom supported for pivoting movement relative to the frame, a first cutter head pivotably coupled to the first boom, and a second cutter head pivotably coupled to the second boom. The second boom is movable independent of the first boom. The first cutter head is movable through a first range of movement and includes a first cutter shaft, a first cutting disc, and a first excitation mechanism. The first cutting disc is supported for free rotation relative to the first cutter shaft about a first cutter axis. The first cutting disc includes a plurality of first cutting bits defining a first cutting edge. The first excitation mechanism includes a first exciter shaft and a first mass eccentrically coupled to the first cutter shaft. Rotation of the first exciter shaft induces oscillating movement of the first cutter shaft and the first cutting disc. The second cutter head is movable through a second range of movement intersecting the first range of movement at an overlap region. The second cutter head includes a second cutter shaft, a second cutting disc, and a second excitation mechanism. The second cutting disc is supported for free rotation relative to the second cutter shaft about a second cutter axis. The second cutting disc includes a plurality of second cutting bits defining a second cutting edge. The second excitation mechanism includes a second exciter shaft and a second mass eccentrically coupled to the second cutter shaft. Rotation of the second exciter shaft induces oscillating movement of the second cutter shaft and the second cutting disc.

Other aspects will become apparent by consideration of the detailed description and accompanying drawings.

Before any embodiments are explained in detail, it is to be understood that the disclosure is not limited in its application to the details of construction and the arrangement of components set forth in the following description or illustrated in the following drawings. The disclosure is capable of other embodiments and of being practiced or of being carried out in various ways. Also, it is to be understood that the phraseology and terminology used herein is for the purpose of description and should not be regarded as limiting. The use of "including," "comprising" or "having" and variations thereof herein is meant to encompass the items listed thereafter and equivalents thereof as well as additional items. The terms "mounted," "connected" and "coupled" are used broadly and encompass both direct and indirect mounting, connecting and coupling. Further, "connected" and "coupled" are not restricted to physical or mechanical connections or couplings, and can include electrical or hydraulic connections or couplings, whether direct or indirect. Also, electronic communications and notifications may be performed using any known means including direct connections, wireless connections, etc.

DETAILED DESCRIPTION

Figure 1:
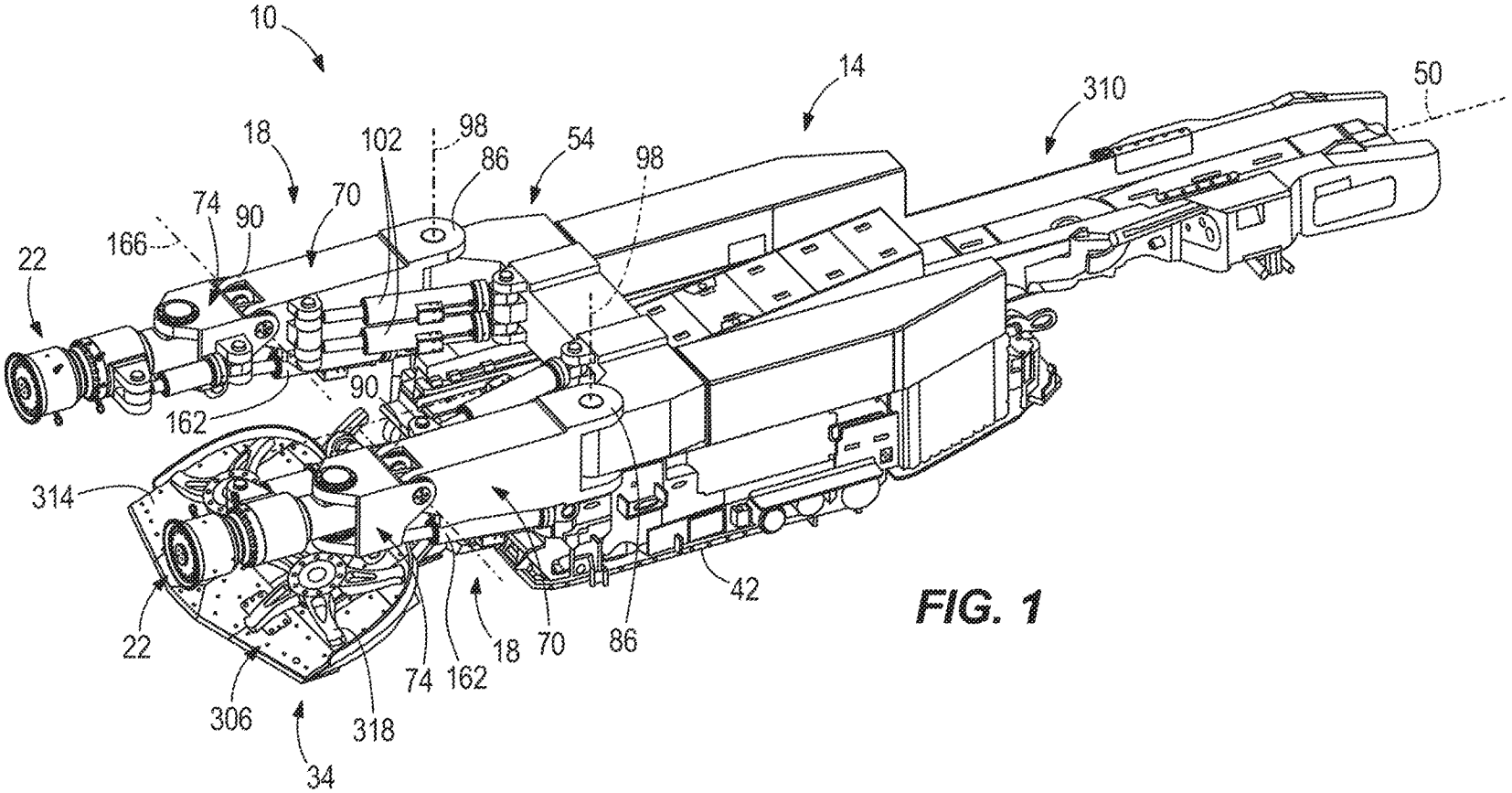
FIG. 1 is a perspective view of a mining machine with a sumping frame in a retracted position.
Figure 2:
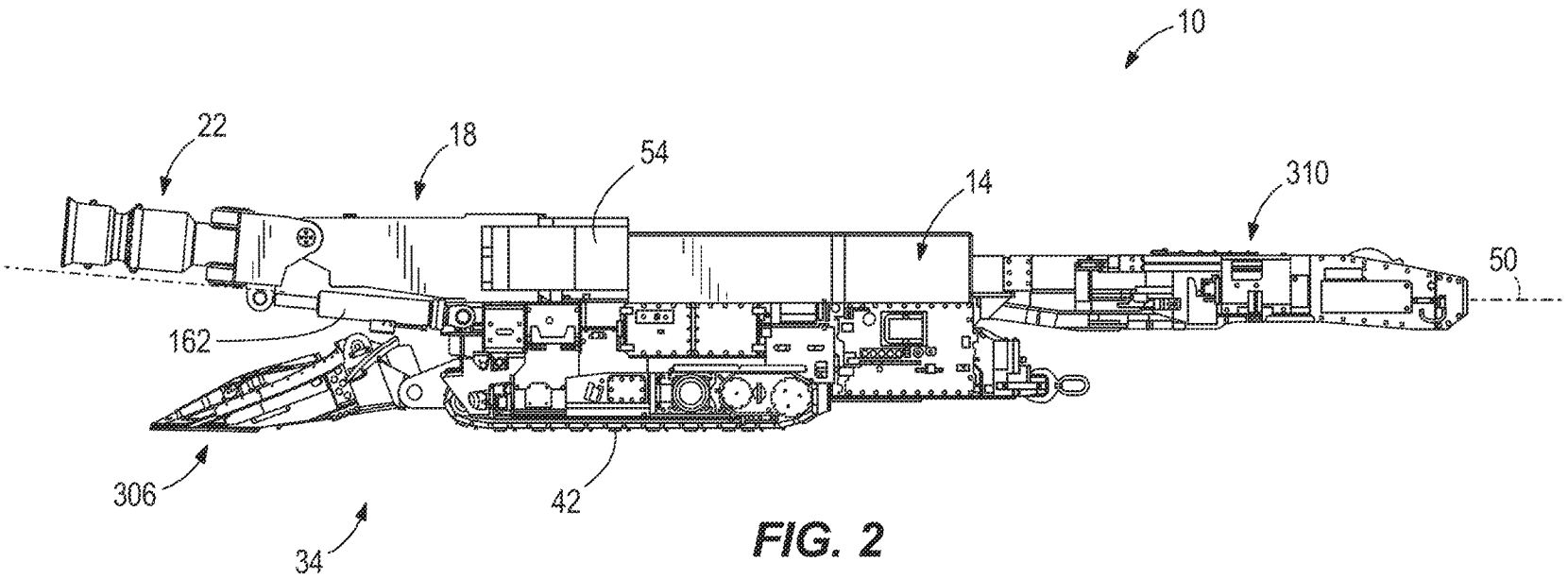
FIG. 2 is a side view of the mining machine of FIG. 1.
Figure 7:
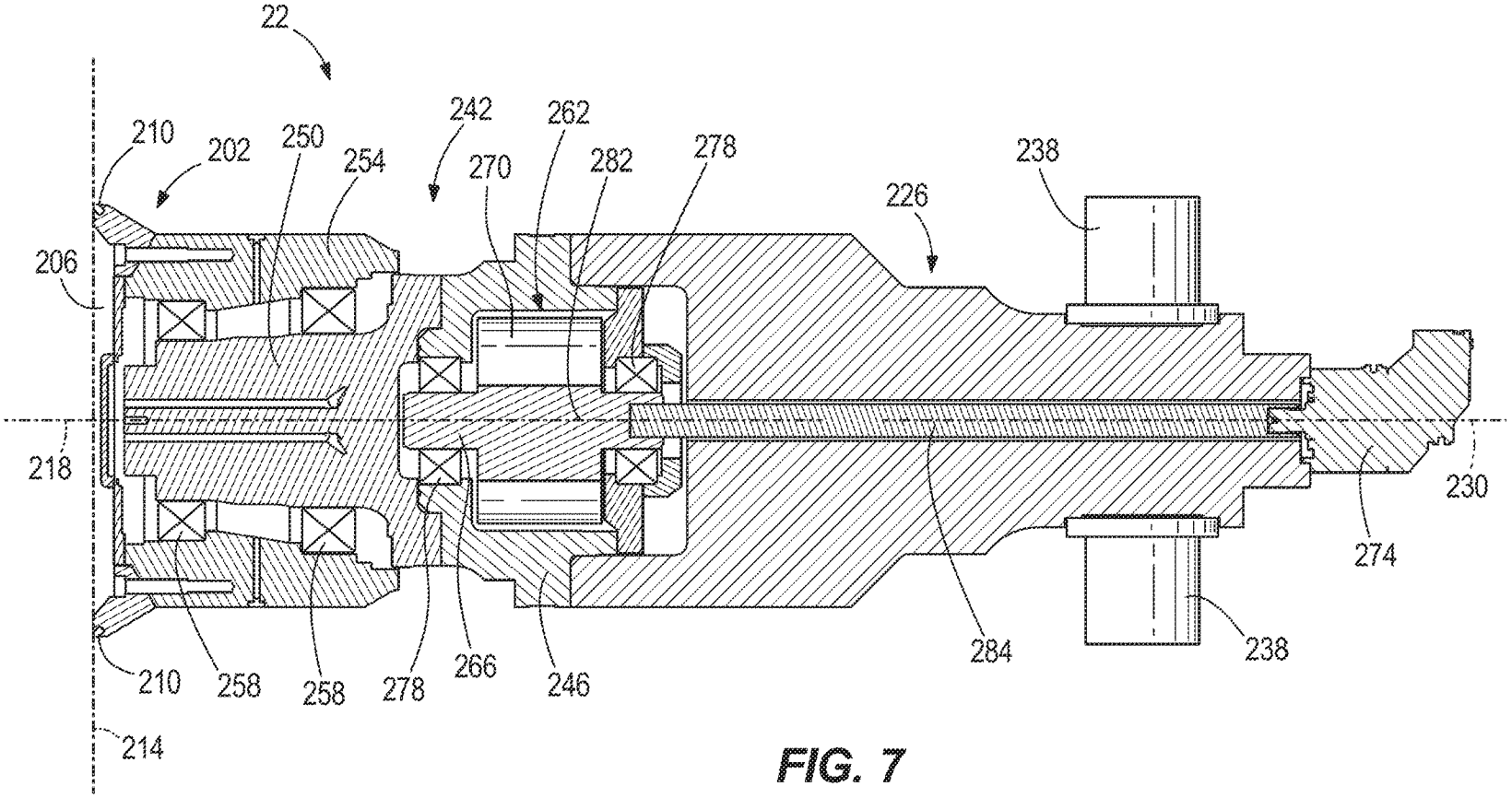
FIG. 7 is a section view of the cutter head of FIG. 5 viewed along section 7-7.

FIGS. 1-2 illustrate a mining machine 10 (e.g., an entry development machine) including a chassis 14, booms 18, and cutter heads 22 for engaging a rock face 30 (FIG. 7). In the illustrated embodiment, the machine 10 further includes a material handling system 34. The chassis 14 is supported on a traction system (e.g., crawler mechanism 42) for movement relative to a floor (not shown). The chassis 14 includes a first or forward end and a second or rear end, and a longitudinal chassis axis 50 extends between the forward end and the rear end. The booms 18 are supported on the chassis 14 by a yoke 54.

Figure 1A:
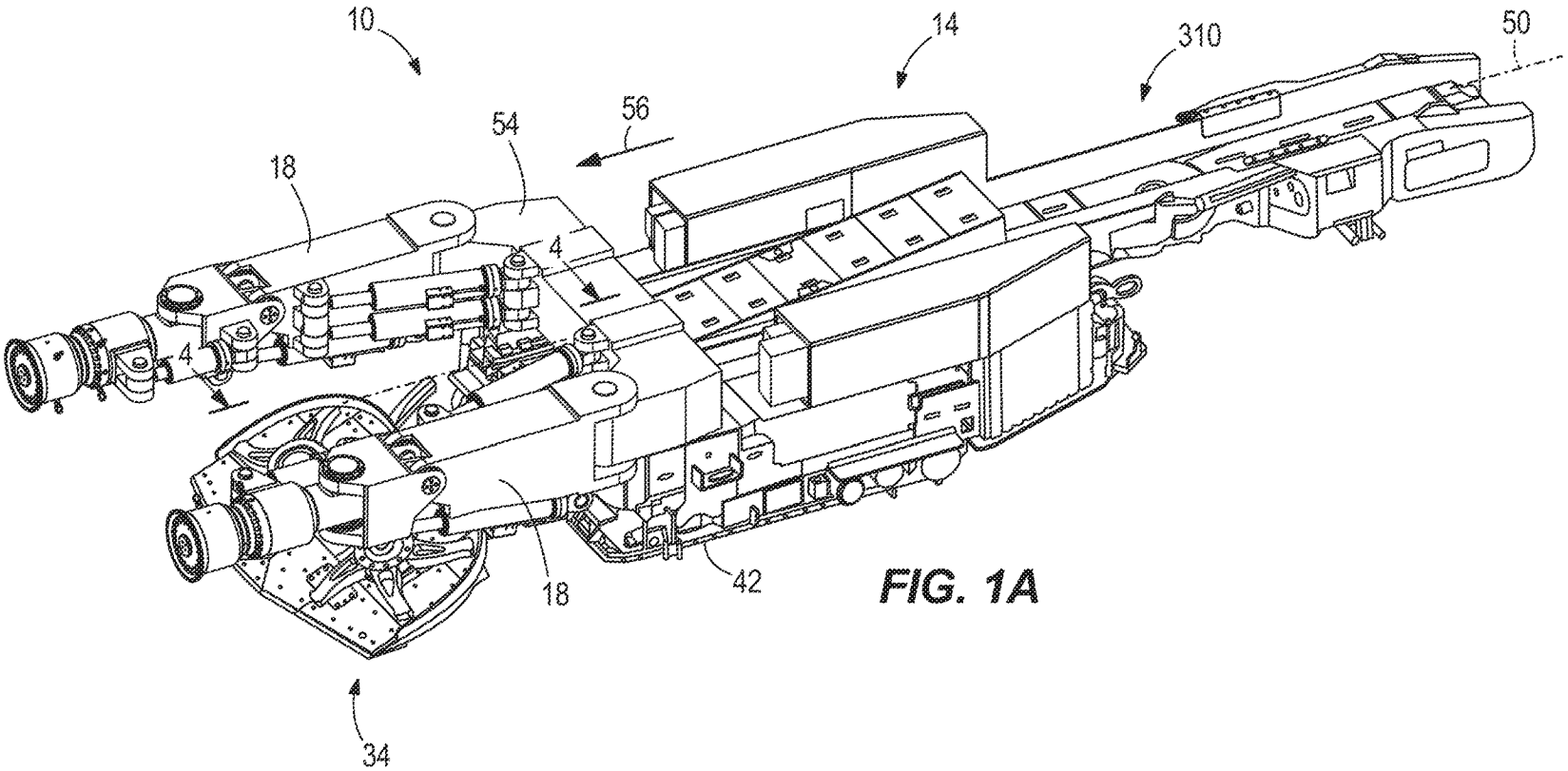
FIG. 1A is a perspective view of a mining machine with a sumping frame in an extended position.
Figure 1B:
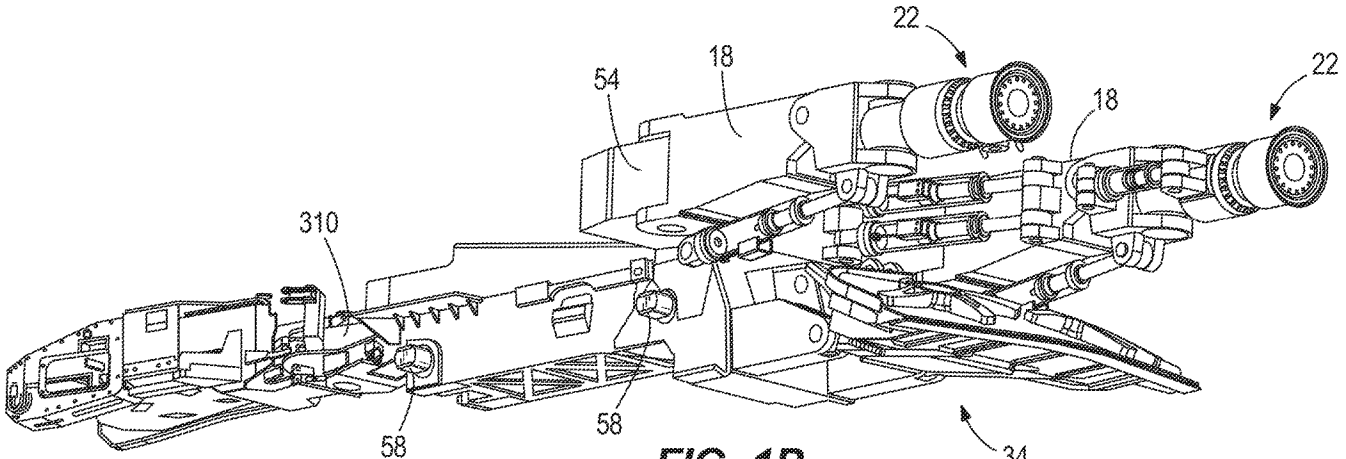
FIG. 1B is a perspective view of the sumping frame.
Figure 1C:
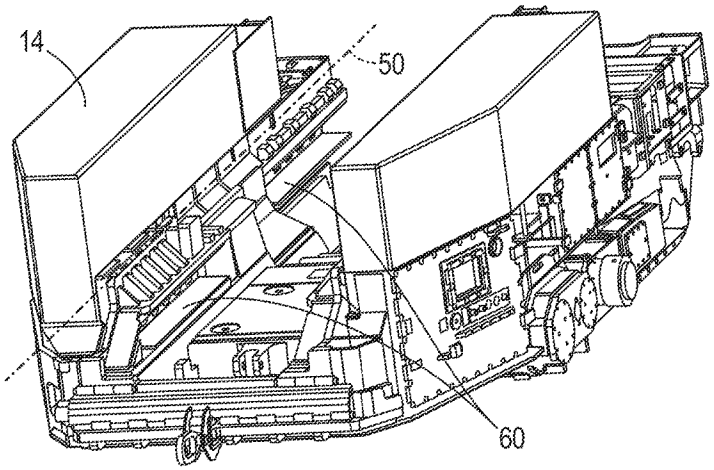
FIG. 1C is a perspective view of a rear end of a chassis.

As shown in FIG. 1A, in some embodiments, the yoke 54 is moveable relative to the chassis 14 in a direction parallel to the chassis axis 50 (e.g., toward or away from the rock face 30—FIG. 7) to permit sumping of the cutter heads 22. In the illustrated embodiment, the material handling system 34 and the yoke 54 are movable together in a direction parallel to the chassis axis 50, thereby permitting the cutter heads 22 to be advanced (e.g., in a forward direction 56) without requiring re-positioning the chassis 14. In some embodiments, the cutter heads 22, the material handling system 34, and the yoke 54 form a sumping frame. As shown in FIG. 1B, the sumping frame includes lateral pins 58 (FIG. 1B) projecting outwardly from each side of the sumping frame in a direction transverse to the chassis axis 50. FIG. 1C shows a perspective view of a rear end of the chassis 14, and the chassis 14 includes slots or guides 60 oriented parallel to the chassis axis 50 for receiving the pins 58. An actuator (e.g., hydraulic cylinders—not shown) moves the sumping frame such that the pins 58 slide within the guides 60.

As shown in FIG. 1, each boom 18 includes a first portion or base portion 70 and a second portion or wrist portion 74 supporting a respective cutter head 22. The base portion 70 includes a first end 86 secured to the yoke 54 and a second end 90 supporting the wrist portion 74. In the illustrated embodiment, the first end 86 is secured to the yoke 54 by a first pin joint oriented in a first direction (e.g., vertical) and the wrist portion 74 is pivotably coupled to the base portion 70 by a second pin joint oriented in a second direction (e.g., transverse to the chassis axis 50). First actuators 102 (e.g., fluid cylinders) may be coupled between the base portion 70 and the yoke 54 to move pivot the base portion 70 about the first pin joint, about a base axis 98. In the illustrated embodiment, each boom 18 includes two first actuators 102; in other embodiments, each boom 18 may have fewer or more actuators 102.

Figure 3:
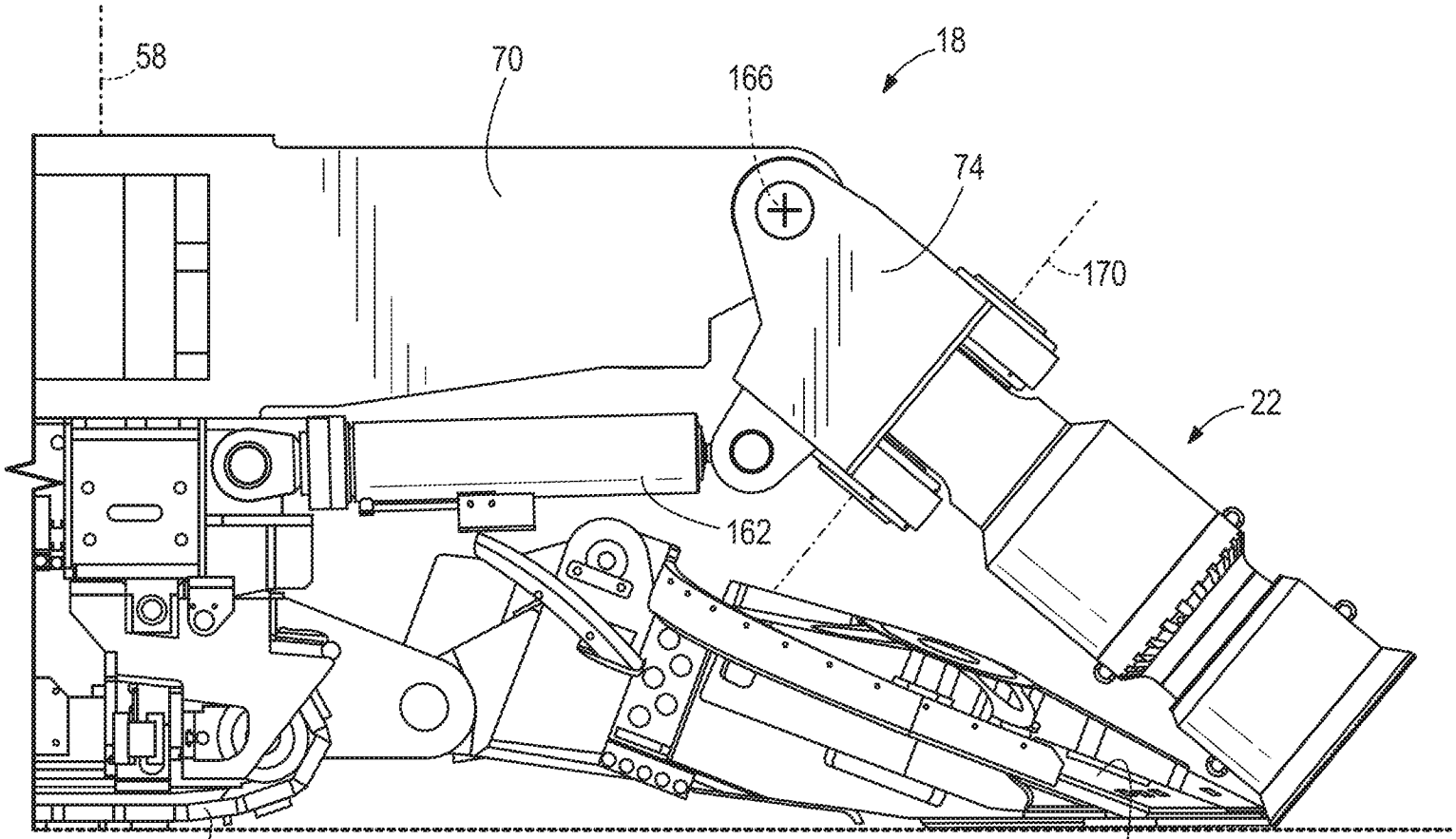
FIG. 3 is a side view of a portion of the mining machine of FIG. 1 with a cutter head in a lower position.

Each wrist portion 74 is pivotable relative to the base portion 70 about the second pin joint due to operation of second fluid actuators (e.g., hydraulic cylinders) or luff actuators 162. In the illustrated embodiment, extension and retraction of the luff actuators 162 causes the wrist portion 74 to pivot about a transverse axis 166 that is perpendicular to the base axis 98. The wrist portion 74 may be pivoted between a first or lower position (FIG. 3) and a second or upper position (FIG. 4), or an intermediate position between the lower position and the upper position. Stated another way, the luff actuators 162 drive the wrist portion 74 to pivot within a plane that is parallel to the base axis 98 and the plane generally extends between an upper end of the machine 10 and a lower end of the machine 10. In the illustrated embodiment, the machine 10 includes two luff cylinders 162; in other embodiments, the machine 10 may include fewer or more actuators 162. Also, in the illustrated embodiment, a lower edge of the cutter head 22 is positioned immediately forward of the material handling system when the cutter head 22 is in the lower position (FIG. 3). In other embodiments, the configuration and orientation of the axes of movement can be modified to meet particular requirements. For example, in some embodiments, the axis about which the wrist portion 74 pivots may be defined by a pin extending in a substantially vertical orientation, and the axis about which the cutter head 22 may be defined by a pin extending in a substantially horizontal orientation. In some embodiments, these axes may intersect one another. In some embodiments, these axes may be coincident.

Figure 4:
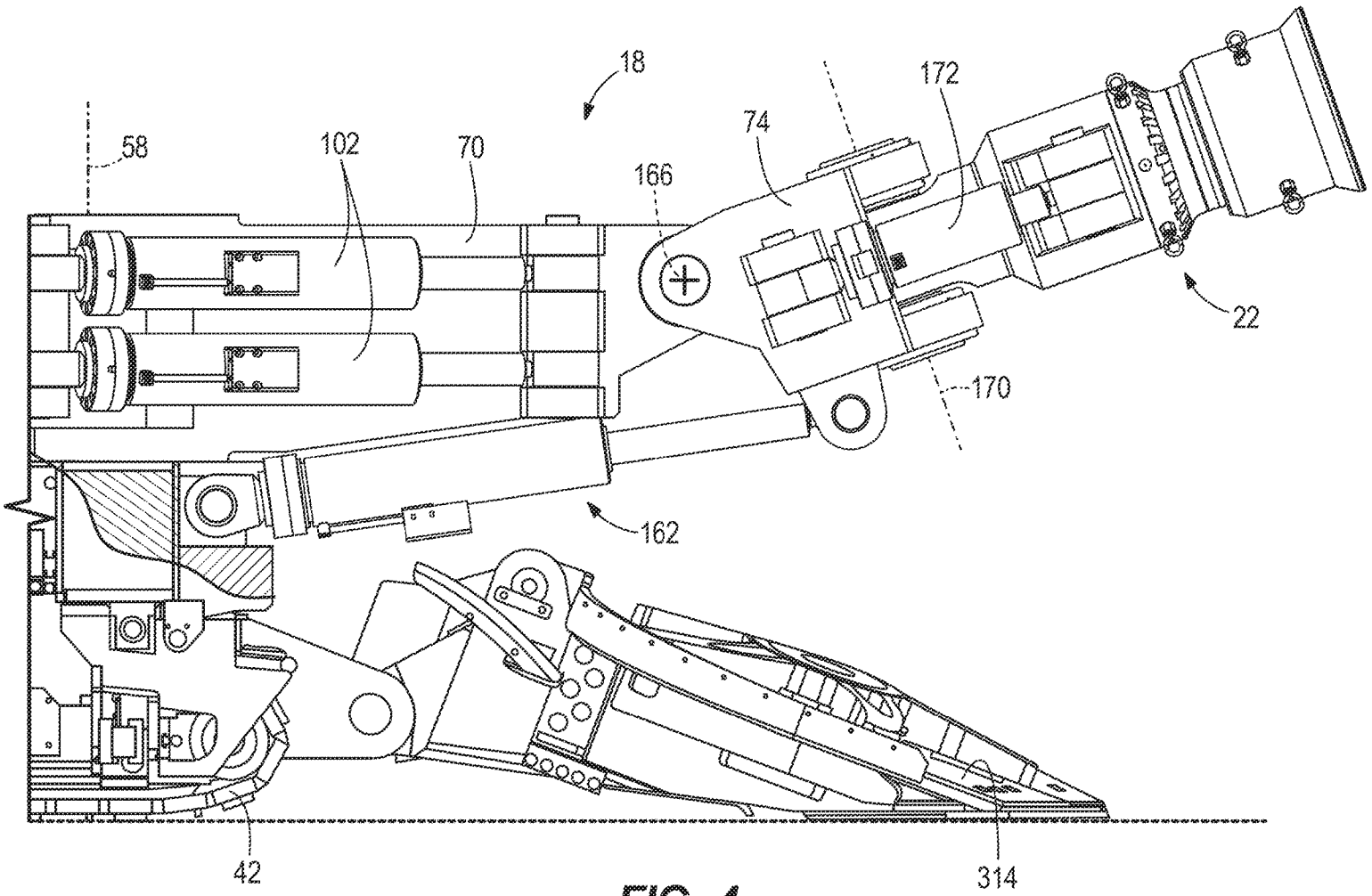
FIG. 4 is a side view of a portion of the mining machine of FIG. 1 with the cutter head in an upper position.

As shown in FIGS. 3 and 4, each cutter head 22 is coupled to a distal end of the respective boom 18, at an end of the wrist portion 74 that is opposite the base portion 70, and each cutter head 22 is supported by a pin connection. In the illustrated embodiment, the pin connection defines a slew axis or pivot axis 170 about which the cutter head 22 pivots. A third actuator or slew cylinder 172 (FIG. 4) is coupled to between the cutter head 22 and the wrist portion 74 to pivot the cutter head 22 about the pivot axis 170. The pivot axis 170 is generally oriented perpendicular to the luff axis or transverse axis 166.

As discussed in further detail below, each cutter head 22 oscillates about transverse axis 166 and pivot axis 170. In the illustrated embodiment, each luff cylinder 162 is operable to position the cutter head 22 about the transverse axis 166 and also acts as a spring or biasing member to permit rotary oscillations of the cutter head 22 at an excitation frequency caused by the operation of the excitation element 262 (described in more detail below). In a similar fashion, each slew cylinder 172 (FIG. 4) is operable to position the respective cutter head 22 about the pivot axis 170 and may also act as a spring or biasing member to permit rotary oscillations of the cutter head 22 at the excitation frequency. In the illustrated embodiment, the cylinders 162, 172 maintain alignment of the axes 166, 170 of the cutter head 22 relative to the wrist portion 74; in other embodiments, other orientations of the cutter head 22 may be controlled.

Figure 5:
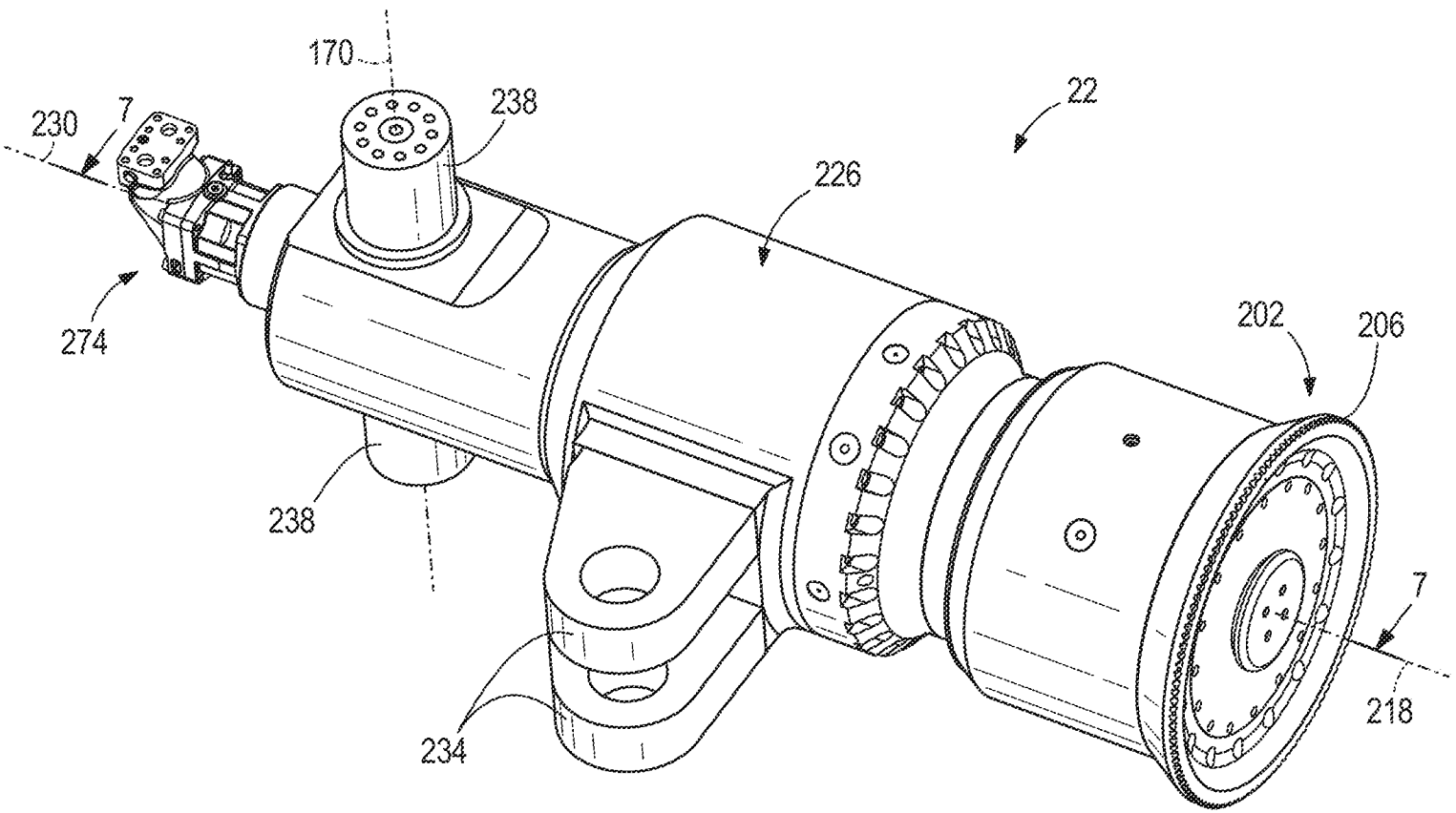
FIG. 5 is a perspective view of a cutter head.
Figure 6:
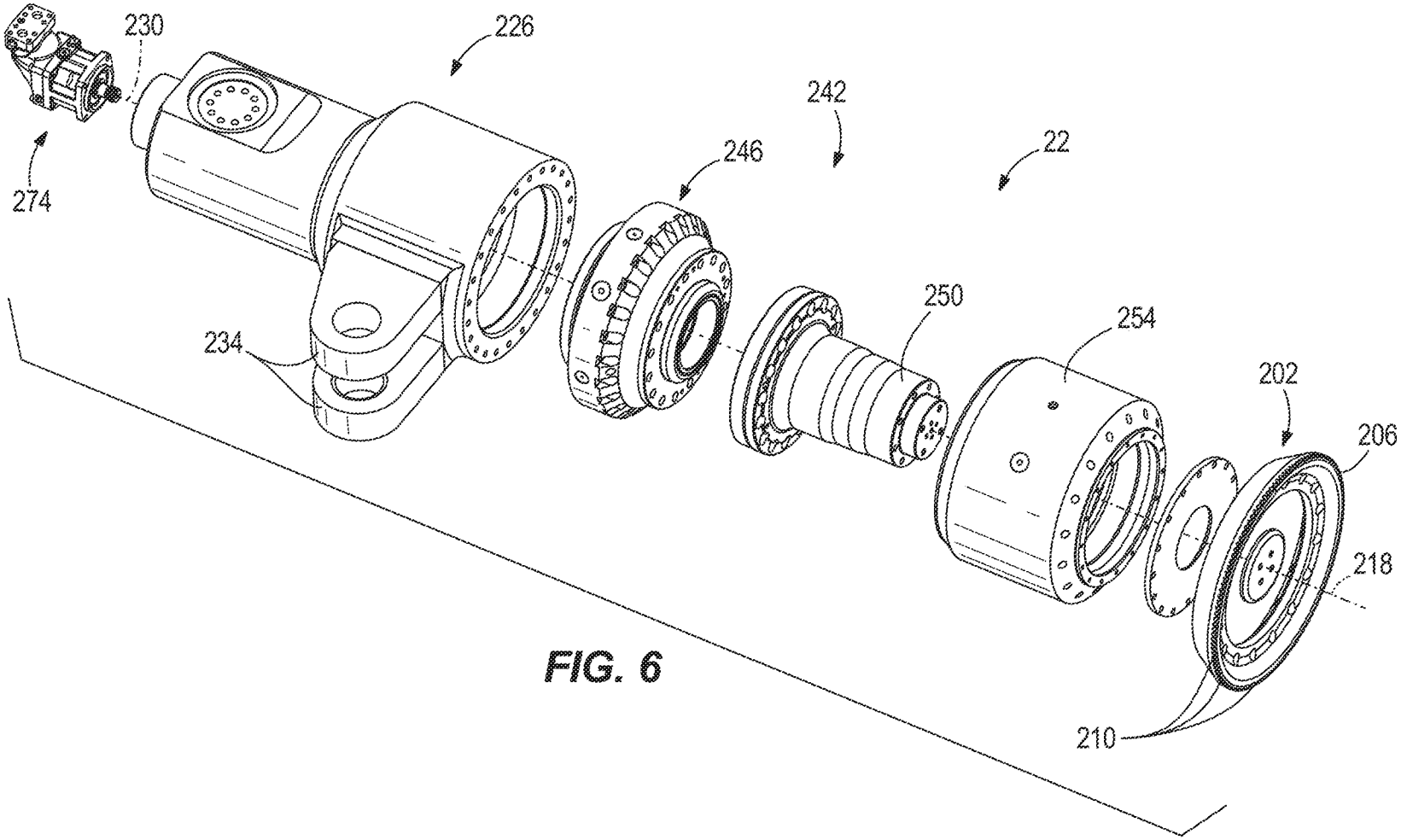
FIG. 6 is an exploded view of the cutter head of FIG. 5.

Referring now to FIGS. 5-7, the cutter head 22 includes a cutting member or bit or cutting disc 202 having a peripheral edge 206, and a plurality of cutting bits 210 (FIG. 6) are positioned along the peripheral edge 206. The peripheral edge 206 may have a round (e.g., circular) profile, and the cutting bits 210 may be positioned in a common plane defining a cutting plane 214 (FIG. 7). The cutting disc 202 may be rotatable about a cutter axis 218 that is generally perpendicular to the cutting plane 214.

As shown in FIG. 5, the cutter head 22 includes a housing 226 generally extending along a housing axis 230. An outer surface of the housing 226 includes lugs 234 that are coupled to the slew cylinders 172 (FIG. 4). The housing 226 also includes projections 238 extending radially outward with respect to the housing axis 230. The projections 238 are received within sockets (not shown) on the wrist portion 74 and generally define the pivot axis 170 about which the cutter head pivots relative to the wrist portion 74.

As shown in FIGS. 6 and 7, the cutter head 22 further includes a shaft 242 removably coupled (e.g., by fasteners) to an end of the housing 226 that is opposite location of the projections 238 (FIG. 7). The shaft 242 includes a first portion 246 positioned adjacent the housing 226 and a second portion 250 extending away from the housing 226. The cutting disc 202 is rigidly coupled to a carrier 254 that is supported on the second portion 250 for rotation (e.g., by tapered roller bearings 258) about the cutter axis 218. In the illustrated embodiment, the second portion 250 is formed as a stub or cantilevered shaft generally extending in a direction parallel to the cutter axis 218. Also, in the illustrated embodiment, the first portion 246 and the second portion 250 are separable components; in other embodiments, the first portion and the second portion may be integrally formed. In still other embodiments, the shaft may be formed as more than two separable components.

As shown in FIG. 7, the cutter head 22 also includes an excitation element 262. In the illustrated embodiment, the excitation element 262 is positioned in the first portion 246 of the shaft 242. The excitation element 262 includes an exciter shaft 266 and an eccentric mass 270 secured to the exciter shaft 266 for rotation with the exciter shaft 266. The exciter shaft 266 is driven by a motor 274 and is supported for rotation (e.g., by spherical roller bearings 278) relative to the first portion 246 of the shaft 242 about an exciter axis 282. In the illustrated embodiment, the exciter axis 282 is aligned with the cutter axis 218; in other embodiments, the cutter axis 218 may be offset or oriented at a non-zero angle relative to the exciter axis 282. In the illustrated embodiment, the motor 274 is positioned adjacent a rear end of the cutter head 22, opposite the projections 238, and is coupled to the shaft 242 via an output shaft 284. The motor 274 may include a torque arm to resist rotation of the motor 274.

The rotation of the eccentric mass 270 induces an eccentric oscillation in the shaft 242, thereby inducing oscillation of the cutting disc 202. In the illustrated embodiment, the excitation element 262 is offset from the second portion 250 (i.e., the portion supporting the cutting disc 202) in a direction parallel to the cutter axis 218. In other embodiments, the excitation element 262 and cutter head 22 may be similar to the exciter member and cutting bit described in U.S. Publication No. 2014/0077578, published Mar. 20, 2014, the entire contents of which are hereby incorporated by reference.

In the illustrated embodiment, the cutting disc 202 is supported for free rotation relative to the shaft 242; that is, the cutting disc 202 is neither prevented from rotating nor positively driven to rotate except by the induced oscillation caused by the excitation element 262 and/or by the reaction forces exerted on the cutting disc 202 by the rock face 30.

Although only one of the booms 18 and one of the cutter heads 22 is described in detail above, it is understood that the other boom 18 and cutter head 22 includes substantially similar features. In the illustrated embodiment, the machine 10 includes a pair of booms 18 and cutter heads 22 laterally spaced apart from one another and positioned at substantially the same height. Each of the booms 18 and cutter heads 22 are movable independent of the other boom 18 and cutter head 22. In other embodiments, the machine 10 may include fewer or more booms 18 and cutter heads 22, and/or the booms 18 and cutter heads may be positioned in a different manner.

Figure 8:
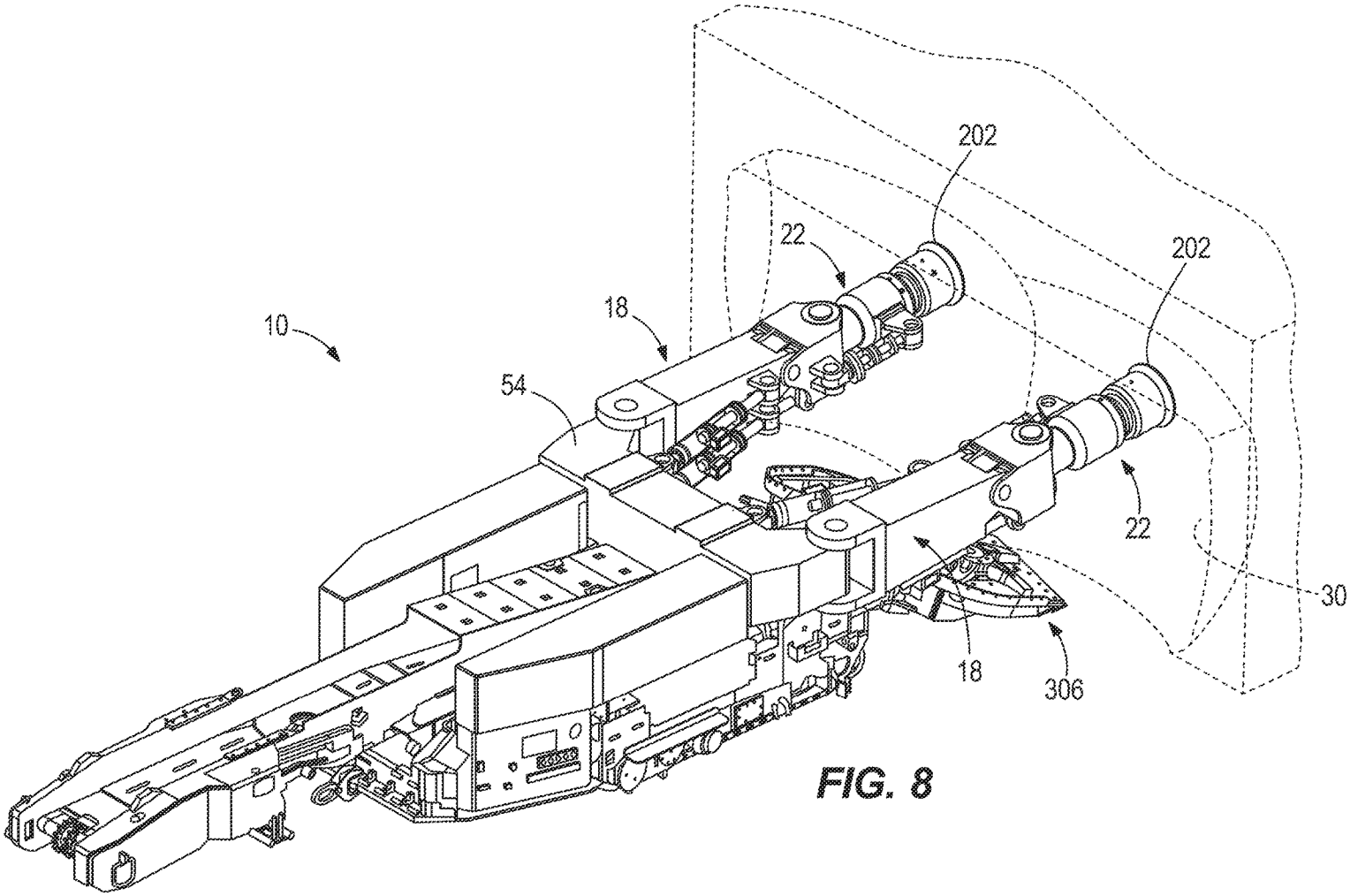
FIG. 8 is a perspective view of the mining machine of FIG. 1 with the cutter heads in a first position.
Figure 9:
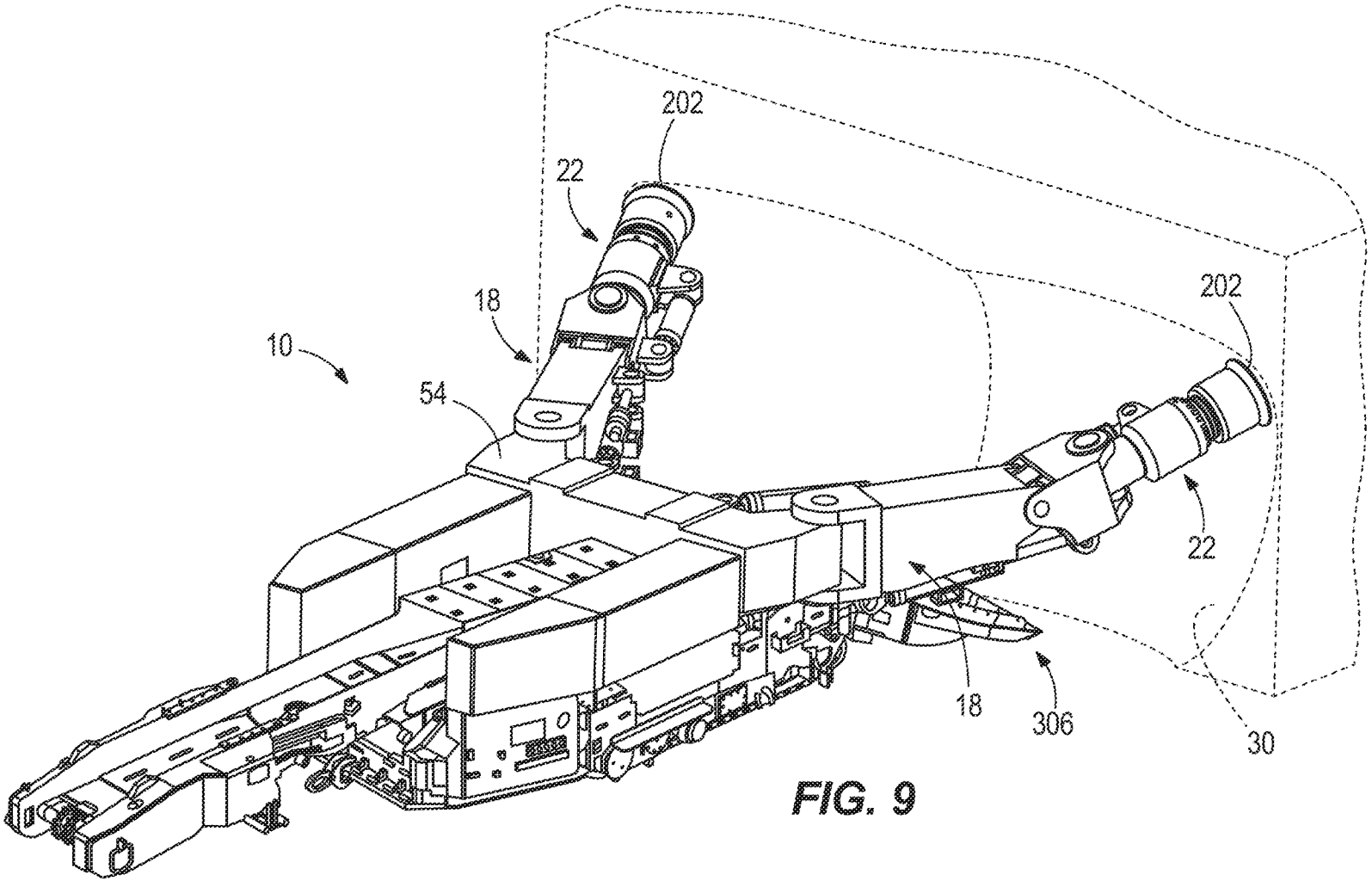
FIG. 9 is a perspective view of the mining machine of FIG. 1 with the cutter heads in a second position.
Figure 10:
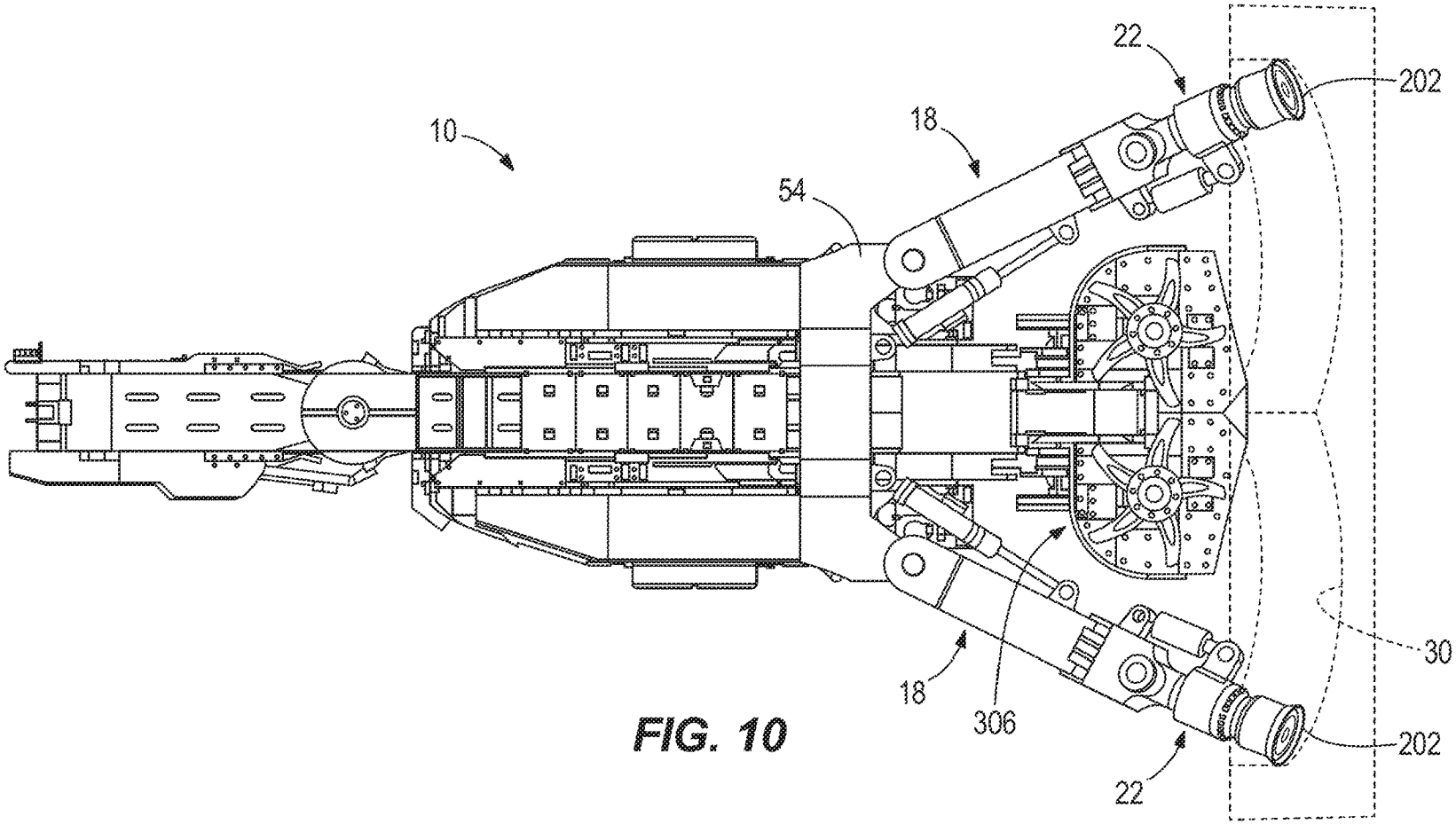
FIG. 10 is a top view of the mining machine of FIG. 9 with the cutter heads in the second position.
Figure 11:
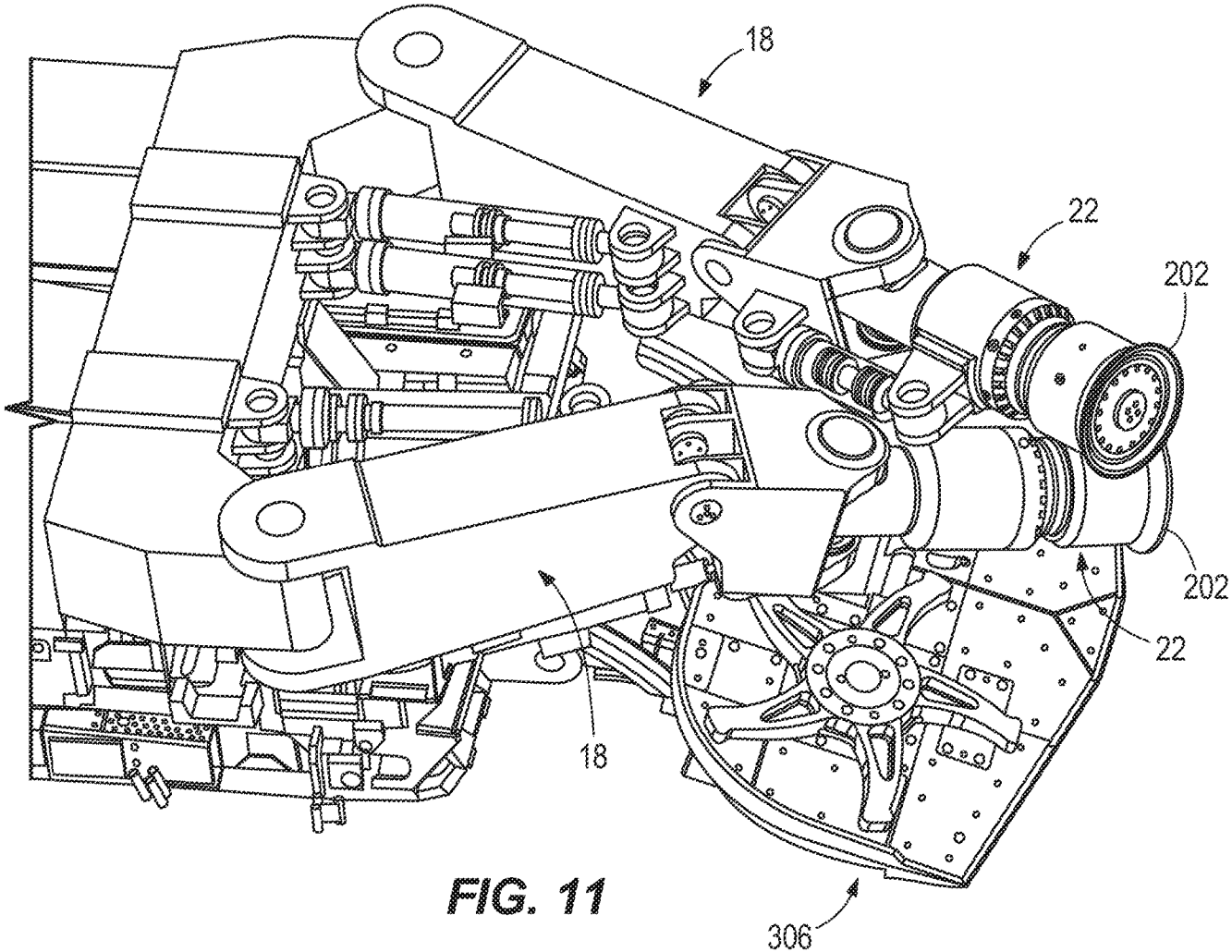
FIG. 11 is a perspective view of the mining machine of FIG. 1 with the cutter heads in a third position.
Figure 12:
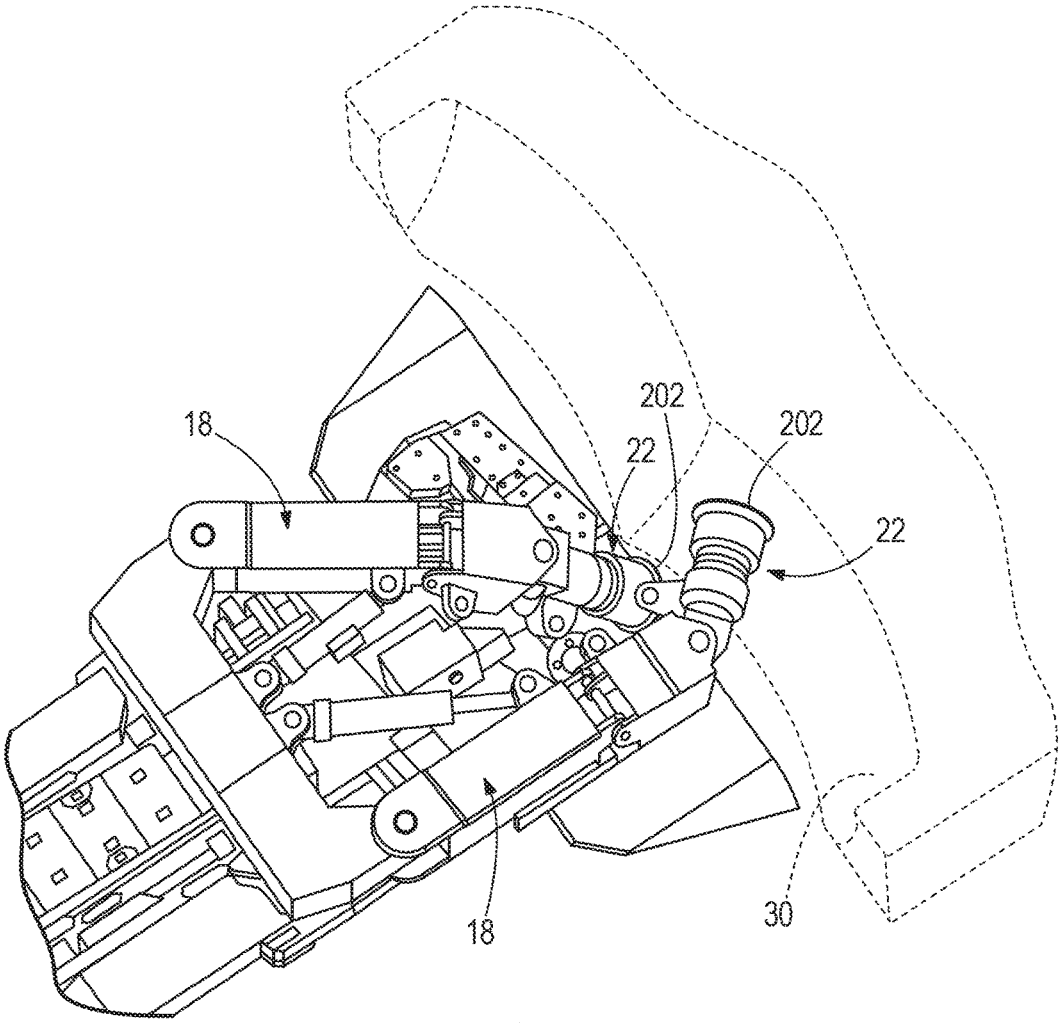
FIG. 12 is a top view of the mining machine of FIG. 1 with the cutter heads in the third position.

Referring now to FIGS. 8-10, each cutter head 22 engages the rock face 30 by undercutting the rock face 30. The cutting disc 202 moves in a desired cutting direction across a length of the rock face 30. A leading portion of the cutting disc 202 engages the rock face 30 at a contact point and is oriented at an acute angle relative to a tangent of the rock face 30 at the contact point, such that a trailing portion of the cutting disc 202 (i.e., a portion of the disc 202 that is positioned behind the leading portion with respect to the cutting direction) is spaced apart from the face 30. The angle provides clearance between the rock face 30 and a trailing portion of the cutting disc 202. In some embodiments, the angle is between approximately 0 degrees and approximately 25 degrees. In some embodiments, the angle is between approximately 1 degree and approximately 10 degrees. In some embodiments, the angle is between approximately 3 degrees and approximately 7 degrees. In some embodiments, the angle is approximately 5 degrees.

As shown in FIGS. 9-12, each cutter head 22 is independently movable through a range of movement that overlaps with the range of movement of the other cutter head 22. However, the configuration of the booms 18 and cutter heads 22 permits overlapping, independent movement of each cutter head 22 without binding or interfering with the movement of the other cutter head 22. The dual cutter head configuration and compact booms 18 permit the machine 10 to engage a wide section of the rock face 30 without requiring a large operating height. In some embodiments, the machine is capable of engaging the rock face 30 across a width of approximately 7 meters and along a height of approximately 2.7 meters. In addition, in some embodiments, the cutter heads 22 may engage the rock face 30 along a desired profile. Also, the use of inertially-excited cutter heads 22 may improve cutting rates, and increase overall mining efficiency compared to conventional entry development machines. The machine 10 may also reduce or eliminate the need for drill and blast operations, may reduce the incidence rate of injury, and may reduce overall operating cost compared to conventional entry development machines.

Referring again to FIG. 1, the material handling system 34 includes a gathering head 306 and a conveyor 310. The gathering head 306 includes an apron or deck 314 and rotating arms 318. As the sumping frame advances, the cut material is urged onto the deck 314, and the rotating arms 318 move the cut material onto the conveyor 310 for transporting the material to a rear end of the machine 10. The conveyor 310 may be a chain conveyor and may be articulated relative to the chassis. In other embodiments, the arms may slide or wipe across a portion of the deck 314 (rather than rotating) to direct cut material onto the conveyor 310. Furthermore, in other embodiments, the material handling system 34 may include another mechanism for removing material from an area in front of the machine 10 and directing the material onto the deck 314.

The sumping frame and associated components (i.e., the booms 18, cutter heads 22, material handling system 34, and yoke 54) may be advanced or sumped toward the rock face 30, permitting significant advancement of the cutting operation without requiring frequent relocation and readjustment of the machine 10. This reduces the time that typically must be spent aligning the machine each time the machine is re-positioned in order to maintain a cut face that is parallel to the previous cut. In addition, the sumping function permits the cutter heads 22 and the material handling system 34 to maintain their relationship to one another as the face is advanced. In addition, as shown in FIG. 3, the lower edges of the cutter heads 22 may be positioned close to the front of the deck 314 at floor level, which facilitates loading cut material onto the deck 314.

Although the cutter head 22 has been described above with respect to a mining machine (e.g., an entry development machine), it is understood that one or more independent aspects of the boom 18, the cutter head 22, the material handling system 34, and/or other components may be incorporated into another type of machine and/or may be supported on a boom of another type of machine. Examples of other types of machines may include (but are not limited to) drills, road headers, tunneling or boring machines, continuous mining machines, longwall mining machines, and excavators.

Figure 13:
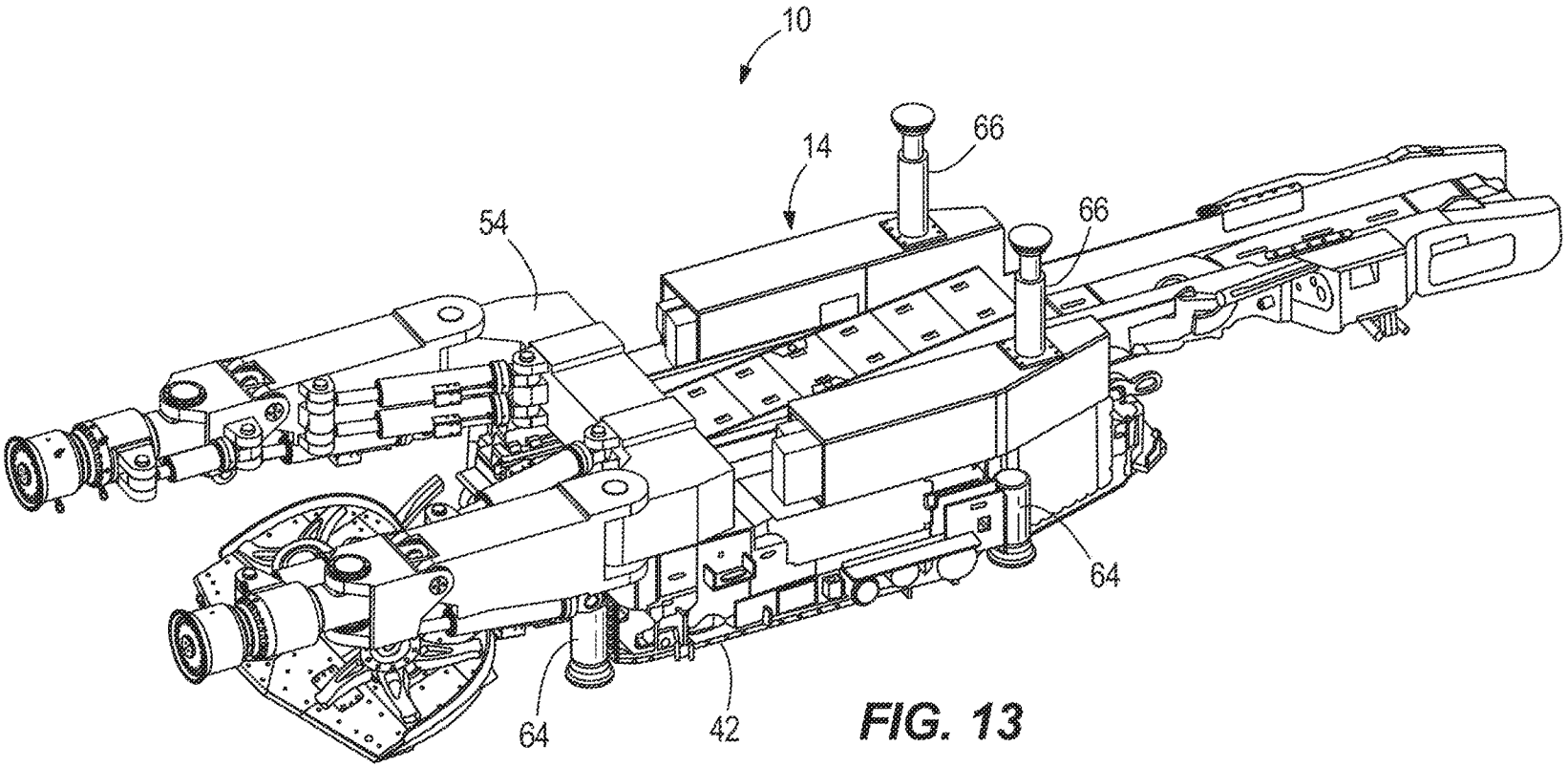
FIG. 13 is a perspective view of a mining machine according to another embodiment.

Also, as shown in FIG. 13, in some embodiments, the machine 10 includes a stabilization system including a plurality of stabilizers or jacks. In the illustrated embodiment, four floor jacks 64 are coupled to the chassis 14, with a pair of floor jacks 64 positioned proximate a rear end of the crawler mechanism 42 and a pair of floor jacks 64 positioned proximate a forward end of the crawler mechanism 42. In addition, a pair of roof jacks 66 are positioned proximate a rear end of the chassis 14. The floor jacks 64 are extendable to engage a floor surface and support the machine 10 off the ground during cutting, while the roof jacks 66 may be extended to engage a roof surface and therefore increase the load exerted on the floor jacks 64. In some embodiments, the stabilization system is similar to the stabilization system described in U.S. Publication No. 2013/0033085, published Feb. 7, 2013, the entire contents of which are hereby incorporated by reference. In other embodiments, the stabilization system may include fewer or more floor jacks and or roof jacks, and/or the jacks may be positioned in a different manner relative to the machine 10.

Figure 14:
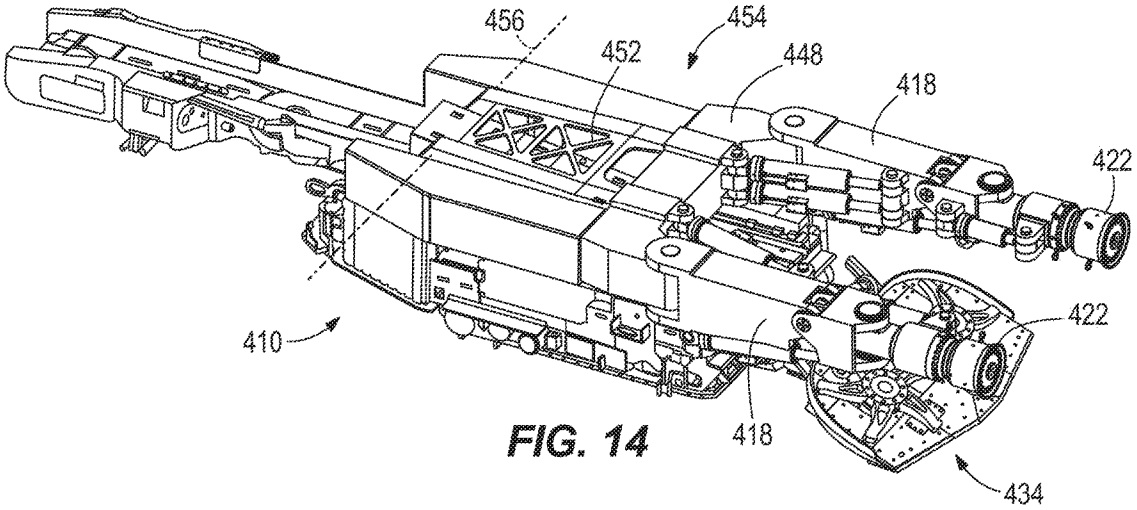
FIG. 14 is a perspective view of a mining machine according to another embodiment, with a yoke in a lower position.
Figure 15:
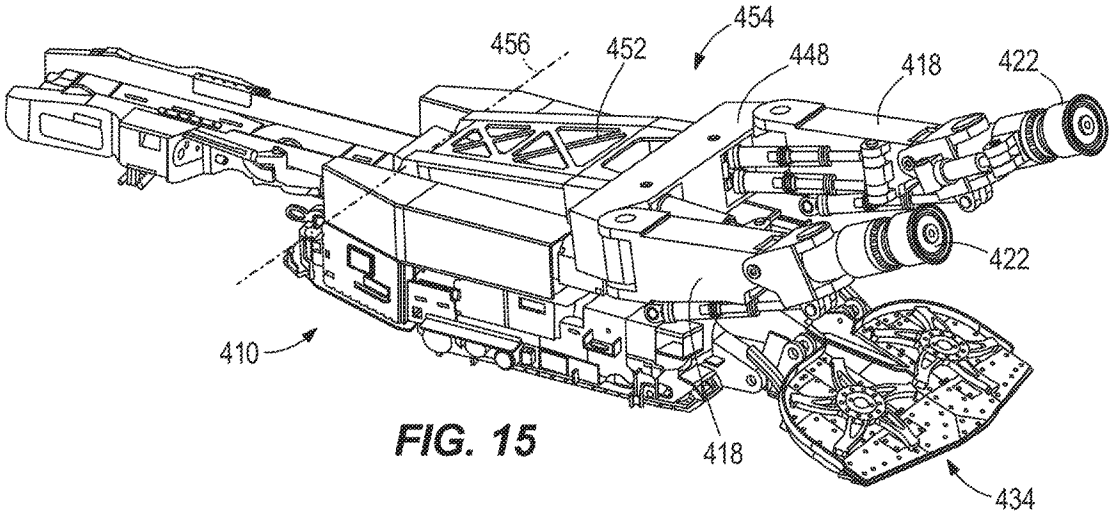
FIG. 15 is a perspective view of the mining machine of FIG. 14 with a yoke in an upper position.

FIGS. 14 and 15 illustrate another embodiment of the mining machine 410. The mining machine 410 is similar to the mining machine 10 described above, and only differences are described for the sake of brevity. Similar features are identified with similar reference numbers, plus 400.

The mining machine 410 includes a yoke 454 including a first portion 448 and a second portion 452. The first portion 448 extends between the booms 418, and each boom 418 is pivotably coupled to the first portion 448. The second portion 452 is an elongated member including one end secured to the first portion 448 and another end pivotably coupled to the sumping frame. The second portion 452 may be pivoted relative to the sumping frame by an actuator (e.g., a fluid cylinder not shown). As a result, the yoke 454 may be pivoted vertically (e.g., about a transverse axis 456) between a lower position (FIG. 14) and a lower an upper position (FIG. 15). In some embodiments, the yoke 454 may be pivoted such that the cutter heads 22 can cut a height of approximately 3.5 meters.

Although various aspects have been described in detail with reference to certain embodiments, variations and modifications exist within the scope and spirit of one or more independent aspects as described.

We claim:

1. A mining machine comprising:

a frame;

a first boom supported for pivoting movement relative to the frame;

a second boom supported for pivoting movement relative to the frame, the second boom being movable independent of the first boom;

a first cutter head pivotably coupled to the first boom, the first cutter head movable through a first range of movement, the first cutter head including a first cutter shaft, a first cutting disc, and a first excitation mechanism, the first cutting disc supported for free rotation relative to the first cutter shaft about a first cutter axis, the first cutting disc including a plurality of first cutting bits defining a first cutting edge, the first excitation mechanism including a first exciter shaft and a first mass eccentrically coupled to the first cutter shaft, rotation of the first exciter shaft inducing oscillating movement of the first cutter shaft and the first cutting disc; and a second cutter head pivotably coupled to the second boom, the second cutter head laterally offset from the first cutter head in a direction transverse to a longitudinal axis of the frame, the second cutter head movable through a second range of movement intersecting the first range of movement at an overlap region, the second cutter head being laterally movable into a position that overlaps a position of the first cutter head in a height direction of the frame, the second cutter head including a second cutter shaft, a second cutting disc, and a second excitation mechanism, the second cutting disc supported for free rotation relative to the second cutter shaft about a second cutter axis, the second cutting disc including a plurality of second cutting bits defining a second cutting edge, the second excitation mechanism including a second exciter shaft and a second mass eccentrically coupled to the second cutter shaft, rotation of the second exciter shaft inducing oscillating movement of the second cutter shaft and the second cutting disc.

2. The mining machine of claim 1, further comprising a yoke supported for movement relative to the frame, the first boom and the second boom each pivotably coupled to the yoke, wherein movement of the yoke advances the first cutter head and the second cutter head in a sump direction.

3. The mining machine of claim 2, wherein the yoke is supported for translational movement relative to the frame in a direction parallel to a longitudinal axis of the frame, and the yoke is also supported by pivoting movement relative to the frame about an axis transverse to the longitudinal axis of the frame.

4. The mining machine of claim 1, further comprising a gathering head coupled to a base of the frame and including a deck having a forward edge, wherein when each cutter head is in a lowermost position, the respective cutting edge is positioned adjacent the forward edge of the deck.

5. The mining machine of claim 1, wherein each cutter shaft includes a first portion and a second portion, each cutting disc supported for rotation on the second portion of the respective cutter shaft, each excitation mechanism positioned adjacent the first portion of the respective cutter shaft.

6. The mining machine of claim 1, wherein each cutter head includes a motor for driving the respective exciter shaft about an exciter axis.

7. The mining machine of claim 6, wherein the exciter axis is aligned with the cutter axis.

8. The mining machine of claim 1, wherein the frame includes a chassis and a sumping frame that is movable relative to the chassis, wherein the first boom and the second boom are coupled to a yoke supported on the sumping frame such that the first boom, the second boom, the first cutter head, and the second cutter head are movable relative to the chassis.

9. The mining machine of claim 1, wherein the boom including a first portion and a second portion pivotably coupled to the first portion, the cutter head coupled to the second portion of the boom, wherein the first portion is pivotable about a first axis and the second portion is pivotable about a second axis that is substantially perpendicular to the first axis.

* * * * *